US011806754B2

(12) United States Patent
O'Brien et al.

(10) Patent No.: US 11,806,754 B2
(45) Date of Patent: Nov. 7, 2023

(54) METHOD AND SYSTEM FOR VOLUME FLOW MEASUREMENT

(71) Applicant: J.M. Canty Inc., Buffalo, NY (US)

(72) Inventors: Paul J. O'Brien, East Aurora, NY (US); Thomas M. Canty, Amherst, NY (US)

(73) Assignee: J.M. CANTY INC., Buffalo, NY (US)

( * ) Notice: Subject to any disclaimer, the term of this patent is extended or adjusted under 35 U.S.C. 154(b) by 174 days.

(21) Appl. No.: 17/295,449

(22) PCT Filed: Nov. 22, 2019

(86) PCT No.: PCT/US2019/062794
§ 371 (c)(1),
(2) Date: May 20, 2021

(87) PCT Pub. No.: WO2020/107014
PCT Pub. Date: May 28, 2020

(65) Prior Publication Data

US 2021/0402438 A1 Dec. 30, 2021

Related U.S. Application Data

(60) Provisional application No. 62/770,763, filed on Nov. 22, 2018.

(51) Int. Cl.

| | |
|---|---|
| ***B07B 1/46*** | (2006.01) |
| ***B07B 1/42*** | (2006.01) |
| ***B07B 13/18*** | (2006.01) |
| ***E21B 21/06*** | (2006.01) |

(52) U.S. Cl.
CPC ..... *B07B 1/46* (2013.01); *B07B 1/42* (2013.01); *B07B 13/18* (2013.01); *E21B 21/065* (2013.01); *B07B 2230/01* (2013.01)

(58) Field of Classification Search
CPC .. B07B 1/46; B07B 1/42; B07B 13/18; B07B 2230/01; E21B 21/065
See application file for complete search history.

(56) References Cited

U.S. PATENT DOCUMENTS

| | | | |
|---|---|---|---|
| 4,015,135 A | 3/1977 | Tipton, Jr. | |
| 9,908,148 B2 * | 3/2018 | Torrione | B07B 13/18 |

(Continued)

FOREIGN PATENT DOCUMENTS

| | | |
|---|---|---|
| GB | 2481655 A | 1/2012 |
| WO | WO 2016210421 A1 | 12/2016 |
| WO | WO 2017040685 A1 | 3/2017 |

*Primary Examiner* — Michael McCullough
*Assistant Examiner* — Kalyanavenkateshware Kumar
(74) *Attorney, Agent, or Firm* — LEYDIG, VOIT & MAYER, LTD.

(57) ABSTRACT

A system for measuring volume flow of a material includes: an imaging receiver for receiving images of a screen deck of a vibratory shaker from an overhead position; at least one illumination device for projecting a line of light onto the screen deck from an angle different than a viewing angle of the imaging receiver to the screen deck; and a mounting bracket for holding the imaging receiver and the at least one illumination device in a substantially fixed relative position to one another and to the screen deck. The system is determines the volume flow of the material based on the images of the screen deck.

19 Claims, 9 Drawing Sheets

(56) References Cited

U.S. PATENT DOCUMENTS

| | | | | |
|---|---|---|---|---|
| 2014/0138323 | A1* | 5/2014 | Jones | B25J 11/00 210/324 |
| 2015/0130926 | A1* | 5/2015 | Sheridan, III | G01N 21/47 348/128 |
| 2015/0377020 | A1* | 12/2015 | Kronenberger | E21B 21/065 210/91 |
| 2016/0130928 | A1 | 5/2016 | Torrione | |
| 2018/0171731 | A1* | 6/2018 | Bingham | B07B 1/4681 |

* cited by examiner

METHOD AND SYSTEM FOR VOLUME FLOW MEASUREMENT

CROSS-REFERENCE TO PRIOR APPLICATIONS

This application is a U.S. National Phase application under 35 U.S.C. § 371 of International Application No. PCT/US2019/062794, filed on Nov. 22, 2019, and claims benefit to U.S. Provisional Patent Application No. 62/770,763, filed on Nov. 22, 2018. The International Application was published in English on May 28, 2020 as WO 2020/107014 under PCT Article 21(2).

FIELD

The present invention relates to a method and system for volume flow measurement.

BACKGROUND

In the oil and gas drilling industry, mud is used to lubricate the drill bit and clear away the cuttings from a hole, and is used to carry the cuttings to the top of the hole and deposit the cuttings in shale shakers. Shale shakers are vibrating screens that separate the liquid mud from the solid cuttings so the liquids can be recycled and sent down hole again. Measuring the solids coming over the end of the shale shaker indicates the drilling process is proceeding, and also indicates that the flow circuit is still intact. When mud flow stops, it is often indicative of a down hole problem, which could be damaging to the well and the top side equipment and personnel.

SUMMARY

In an embodiment, the present invention provides a system for measuring volume flow of a material, the system comprising: an imaging receiver configured to receive images of a screen deck of a vibratory shaker from an overhead position; at least one illumination device configured to project a line of light onto the screen deck from an angle different than a viewing angle of the imaging receiver to the screen deck; and a mounting bracket configured to hold the imaging receiver and the at least one illumination device in a substantially fixed relative position to one another and to the screen deck, wherein the system is configured to determine the volume flow of the material based on the images of the screen deck.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
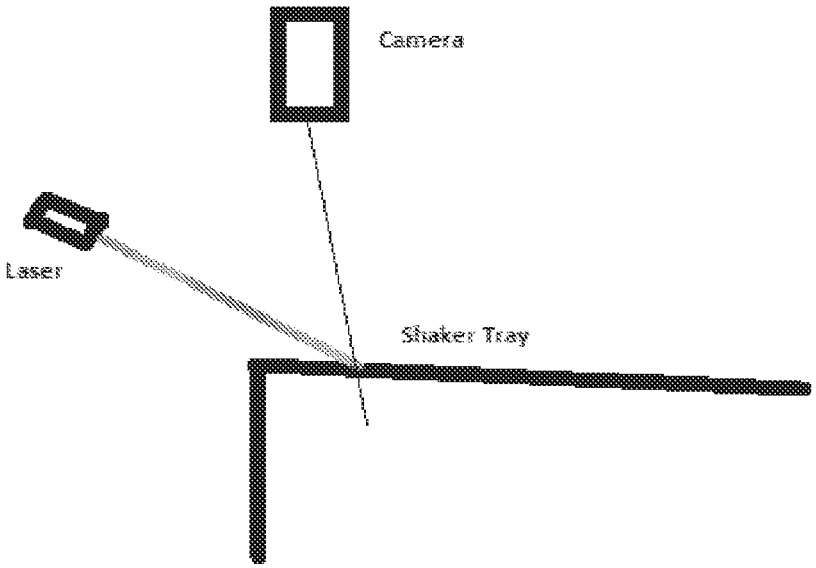
FIG. 1 illustrates and embodiment of a system with a clean shaker tray.

In an embodiment, the present invention provides a system for measuring volume flow of a material that includes: an imaging receiver configured to receive an image of a screen deck of a vibratory shaker from an overhead position; at least one illumination device configured to project a line of light onto the screen deck from an angle different than a viewing angle of the imaging receiver to the screen deck; and a mounting bracket configured to hold the imaging receiver and the at least one illumination device in a substantially fixed relative position to one another and to the screen deck. The system is configured to determine the volume flow of the material based on the images of the screen deck.

Embodiments of the present invention provide a volume flow measurement device for use in drilling.

Embodiments of the present invention provide a system having an image sensor (e.g., a camera) of any type sensitive to the illuminating light, which is used to view a flowing mass of material on a shale shaker (or other type vibratory feeder or conveyor) in order to determine the height of the material (e.g., cuttings) on the shaker tray and—with knowledge of the average velocity of the material—calculate a volume flow rate. To accurately determine the average height of the material flow on the shaker, embodiments of the present invention use a camera with a high frame capture rate in order to create a high resolution integration of images (e.g., a video), and a light source that can project a narrow line (e.g., a line a quarter of an inch wide, although a narrower or wider line could also be acceptable) across the shaker tray for the camera to monitor. For example, the frame capture rate may be thirty frames per second and the resolution can be two megapixels or higher. The frame capture rate and/or resolution can be increased or decreased depending on the required accuracy.

In an embodiment, an imaging receiver is provided for viewing the screen deck of a vibratory shaker from an overhead position and an illumination device which can project a bright, thin line from an angle different than the imaging device onto the screen deck. The receiver and illuminator are kept in a fixed relative position to one another and to the screen deck by the mounting bracket which has the capability to move in a substantially vertical direction, as the screen deck is tilted upward from a horizontal position, e.g., via a worm gear assembly. A structure housing the worm gear assembly can be mounted off vertical by 3-7 degrees in order to move in substantially the same direction as the tip of the screen deck as it is tilted thereby ensuring the capability to maintain a substantially fixed relative position to the screen deck as it moves through a sweep of approximately horizontal to 7 degrees up.

In an embodiment, the image receiver is able to detect the moving material so that as product moves on the tray the bright, thin line is deflected, horizontally from the perspective of the camera, by an amount in linear relationship to the particle or material height on the screen.

In an embodiment, the image receiver is configured to use the reference to allow for minor adjustments to the calculation such as if the screens move over time.

In an embodiment, the image receiver is configured to use the reference to allow for recalibration if any of the components are moved or misaligned and need to be put back in place.

In an embodiment, the image receiver is configured such that when the tray tilts, an electromotor is engaged that moves the entire camera and illumination assembly up or down and the camera illumination assembly is repositioned by locating itself based on the reference points.

In an embodiment, multiple illumination devices are used. Multiple illumination devices can be used, for example, when tray surfaces are corrugated in form and so a single illuminator may be blocked from reaching areas of the tray where material is tracked.

In an embodiment, the camera/illumination instrument has wings that are configured to pivot into position to be clamped to the top rails of the shaker device in order that the camera and illumination devices (together the camera/illumination structure) can be unclamped from its base and move with the changing position of the shaker tray as it tilts up or down. When an optimal tray tilt angle is found, the camera/illumination structure is reclamped to its base and the wings are detached from the shaker device and folded back while not in use.

In an embodiment, the camera/illumination structure attaches to the base mount by a vise or similar clamping device, which when loosened allows the camera/illumination structure to move freely up and down along a radial path as the shaker tray is tilted up and down which is a pivoting move around the back end of the shaker. Once the move is complete the vise clamps back onto the CI structure holding it in place and keeping it in a fixed relative position to the tray.

In an embodiment, the image receiver is configured to execute software that calculates the volume of material flowing up the shaker tray. Volume is equal to the height profile of each scan multiplied by the velocity multiplied by the scan duration.

The methods and systems for volume flow measurement according to the present invention provide advantages over the state of the art, including providing a modular and economical solution to efficiently calculate and monitor material from a down hole drilling system.

Figure 2:
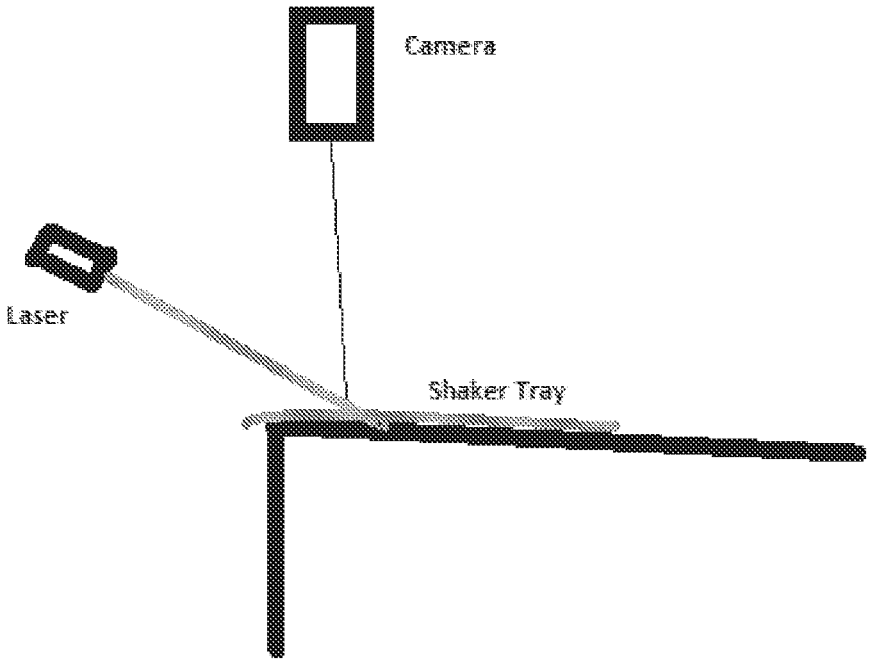
FIG. 2 illustrates an embodiment of a system with material on a shaker tray.

There are multiple ways that a system according to the present invention can be configured. For example, in an embodiment the camera is positioned above the end of the shaker tray, and the light (e.g., a line projecting green laser) illuminates the shaker tray from in front of the shaker at a different angle as shown in FIG. 1 and FIG. 2. For example, a difference between the angles could be twenty to ninety degrees. Other angles can be used with reflective devices. FIGS. 1 and 2 each show a system of the present invention having a camera, a light source (here, a laser), and a shaker tray. In FIG. 1, the shaker tray is clean, that is no material (e.g., cuttings and mud) is on the shaker tray. In FIG. 2, the shaker tray has material (e.g., cutting and mud) on it.

Figure 4:
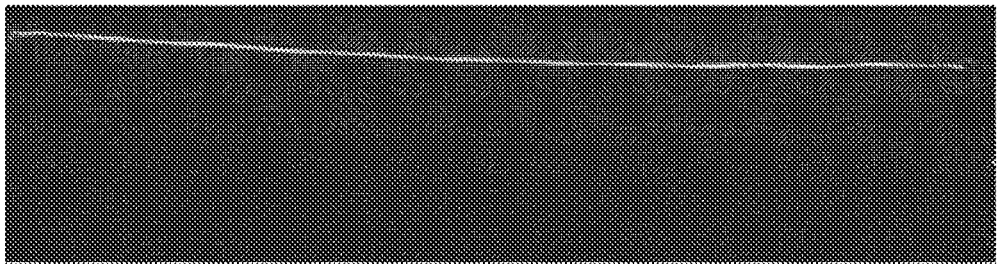
FIG. 4 illustrates a laser on an empty tray.
Figure 5:
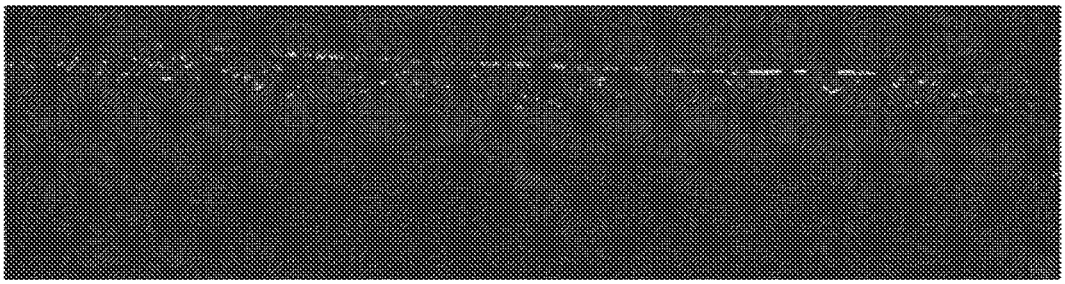
FIG. 5 illustrates a laser illuminating a material.

When the material moves up the shaker tray and is illuminated by the light (e.g., a laser), the material's height changes the position of the light illuminated on the shaker tray, and that change in position is directly proportional to the material height, for example as shown in FIG. 4 and FIG. 5. Taking a large number of images per second (e.g., twenty to thirty images per second to report a flow rate every five to ten seconds) and detecting the light (e.g., laser line) position across the shaker tray gives a high resolution height of material. Averaging these readings then, and knowing the velocity of the material flow up the tray (e.g., via calculating or setting it), allows the volume rate to be calculated. More images per second will improve the flow rate update time.

FIGS. 4 and 5 show how the material on the tray changes the light (e.g., laser line) position from the camera's viewing position. FIG. 4 shows an image from a laser light on an empty shaker tray, and FIG. 5 shows an image of a laser light illuminating material on a shaker tray.

According to the configuration of the system, the line position of the light changes proportional to the height of material on the shaker tray that the light reflects off. For example, as shown in FIG. 5. According to an embodiment, the change in height of the position of the light is integrated across the tray width; and together with the velocity, the volume rate is calculated by the system.

The volume rate can be calculated according to the following equation: $V=H_{avg}\times W\times v$. Here, V is the volume rate; $H_{avg}$ is average height; W is the screen width; and v is the velocity. The volume can be calculate from the volume rate according to the following: $V=V\times t$. Here, V is volume and t is time.

The velocity value can be an input based on calibration exercise, or can be directly calculated from the camera images. For example, by the system executing an algorithm that calculates a net distance a particle has moved from one image to another, and by dividing with the time between images to calculate a velocity.

In the system according to an embodiment of the invention, screen baskets move in a back and forth or elliptical path to vibrate material (e.g., cutting material) up the length of the shaker tray. Over time, the zero point for the light line (e.g., the laser line) may shift slightly as the mean position of the screen surface moves up or down due to the inexactness of the shaker system (which can be, for example, spring based).

Figure 6A:
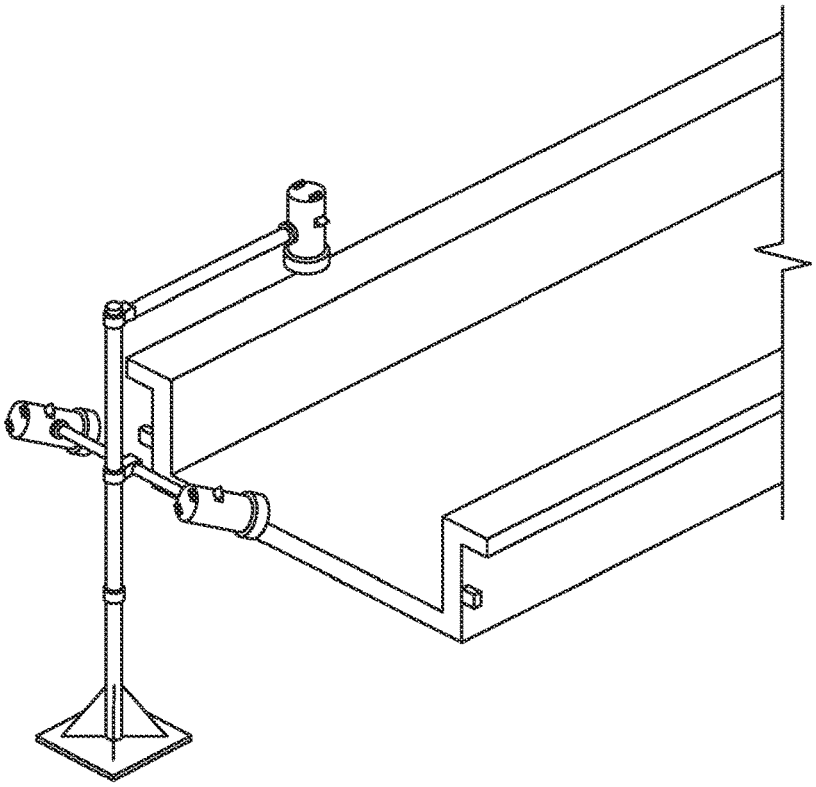
FIG. 6 illustrates isometric views of embodiments systems with reference points mounted from a floor (FIG. 6A) and from a ceiling (FIG. 6B)
Figure 6B:
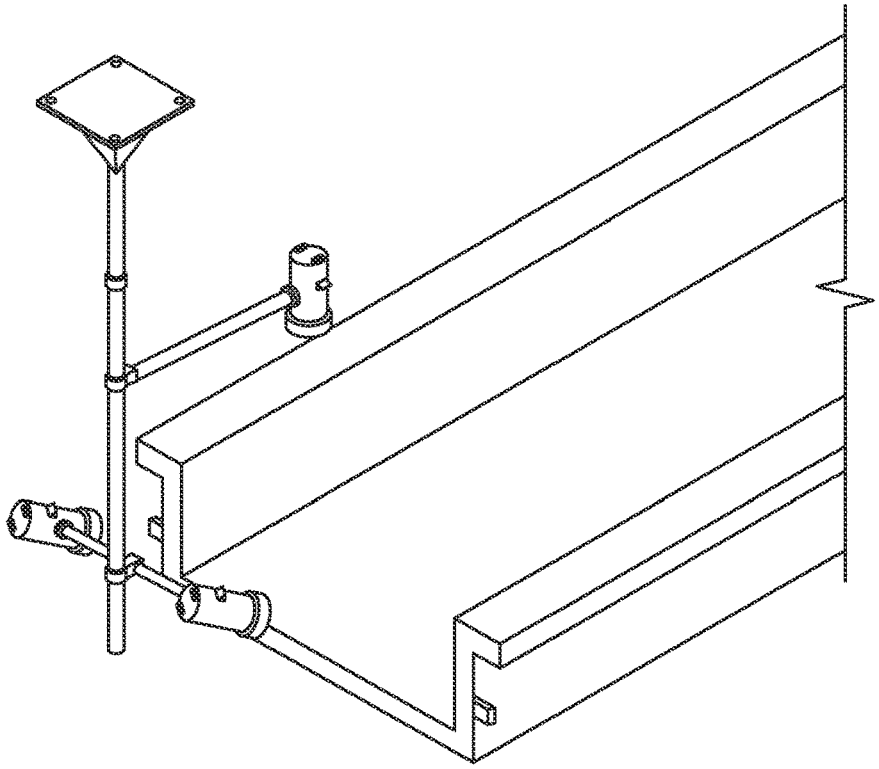

To correct for this shifting of the zero point, in an embodiment, one or more reference points are mounted onto the shaker screen baskets within the camera view. FIGS. 6*a* and 6*b* illustrates embodiments of system having reference points. FIG. 6*a* shows a floor mounted system, and FIG. 6*b* shows a ceiling mounted system.

A reference point is located so the light line (e.g., laser line) crosses the reference surface to allow the camera to see the laser line and detect a move off of the zero point. When this occurs the system (e.g., via execution of software) can then make an adjustment to the calculated area, while the system is operating. Accordingly, in such embodiments, no recalibration is required. The reference point can be mounted in multiple locations, for instance on the inside of the side wall of the basket, or on the front outer edge of the end of the basket structure.

Figure 7:
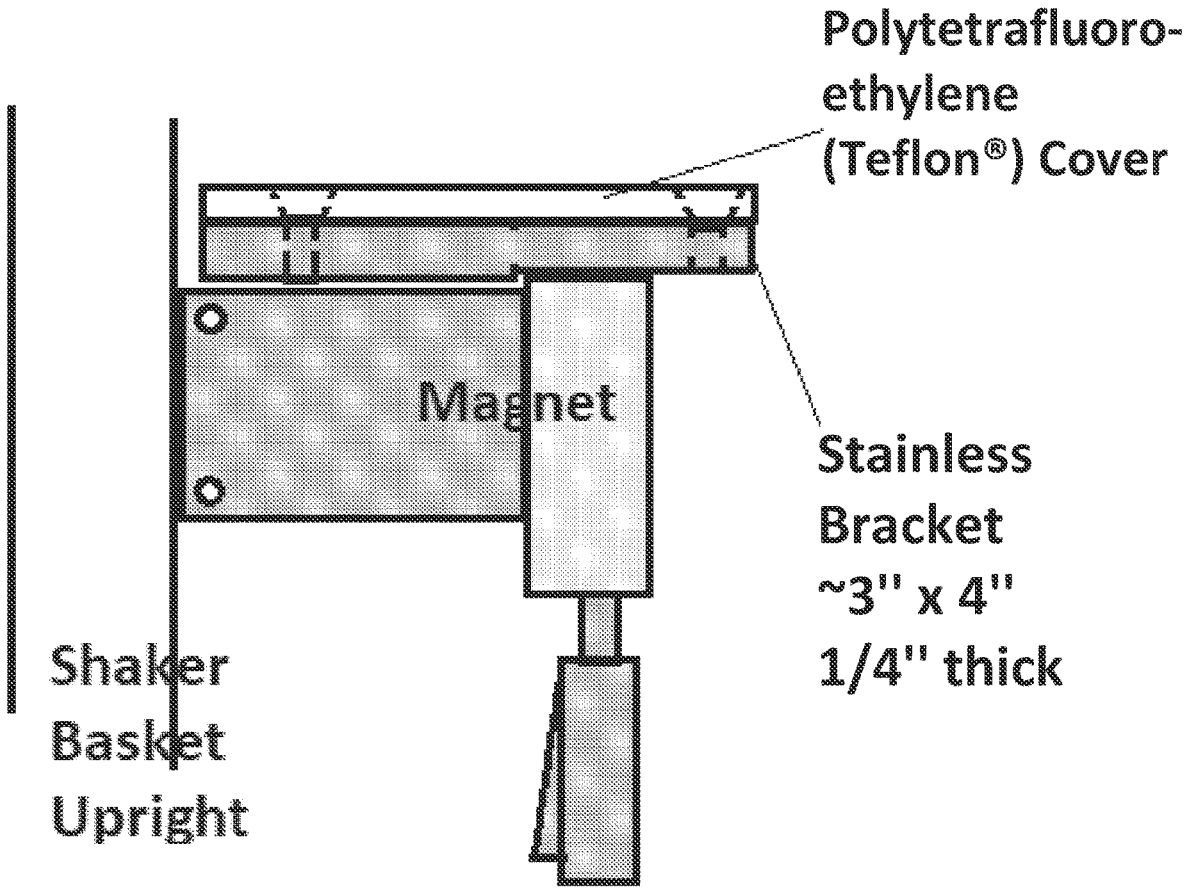
FIG. 7 illustrates and embodiment of a reference attachment.

Reference points can be attached by any suitable means, including magnetic attachment as is shown in FIG. 7.

In an embodiment, shaker tilt is used to control the separation process on the shaker screens (e.g., in an embodiment where the trays are screens). Here, the shaker screens can be tilted up or down (e.g., between O and 6 degrees) from time to time. With the camera/illumination system (e.g., structure) mounted in front of the shaker, a change in the tilt of the shaker will alter the position that the camera sees the light line (e.g., laser line) on the shaker tray. This change then negates the calibration of the system, which would need to be redone.

Figure 3:
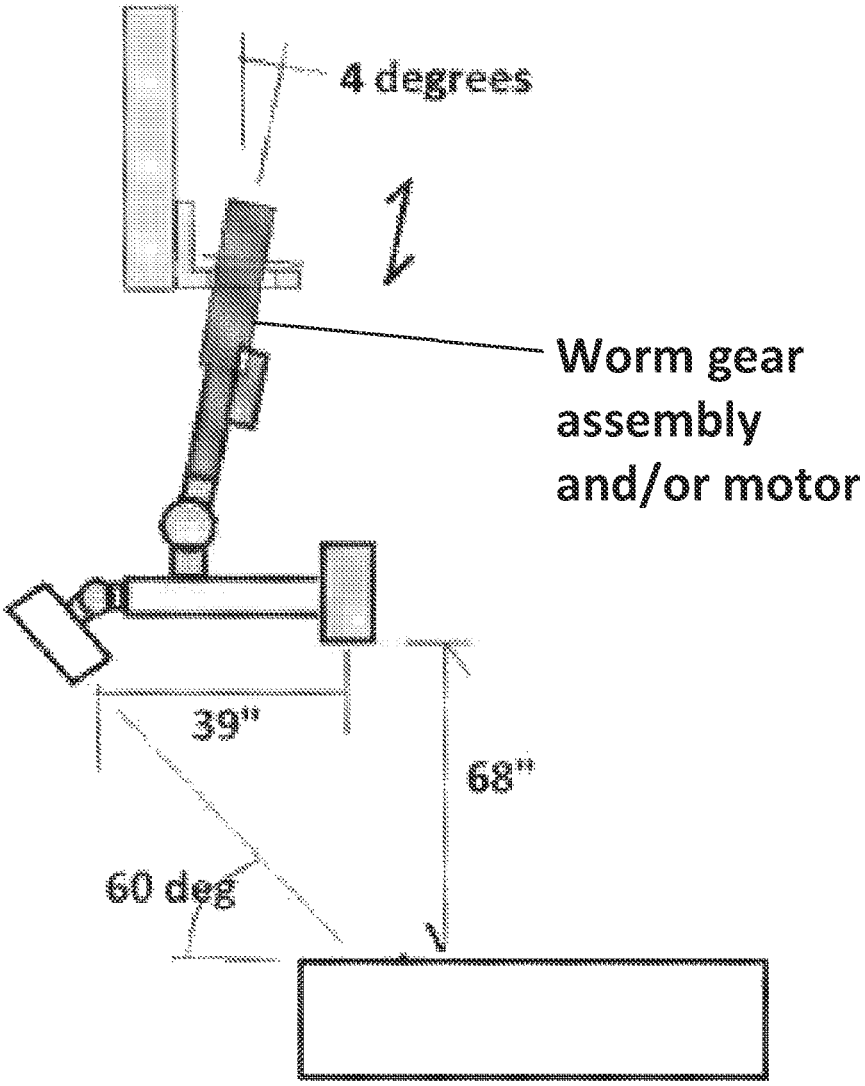
FIG. 3 illustrates an embodiment of an overhead mount to align camera if shaker tilt changes.

However, in order to avoid recalibration, an embodiment of the present invention includes an overhead mount to align the camera when the shaker tilt is changed. FIG. 3 illustrates an embodiment having an overhead mount to align a camera if shaker tilt changes. While FIG. 3 illustrates exemplary dimensions of an embodiment, embodiments of the present invention are not so limited. For example, the dimensions shown would suitably change to fit other types of shakers (such as those currently available on the market).

The overhead mount may be, for example, aligned at approximately 4 degrees from perpendicular. In this exemplary arrangement, as the shaker tilts, the system is moved on that plane such that the camera orientation will stay close to the original light line (e.g., laser line) location. To verify the camera is still oriented on (e.g., set to) the same location, a device to check position can be used. An example of such a device is a ball on a string hung down from the camera to just touch the shaker screen and confirm the relative vertical position of the camera/lasers and screen have not changed.

In another embodiment of the present invention, reference points are alternatively or additionally included on either side of the shaker to allow for the understanding (e.g., evaluation and/or determination) of the incline of the shaker. This allows recalibration to be completed as needed and understanding the changes in incline.

Figure 8:
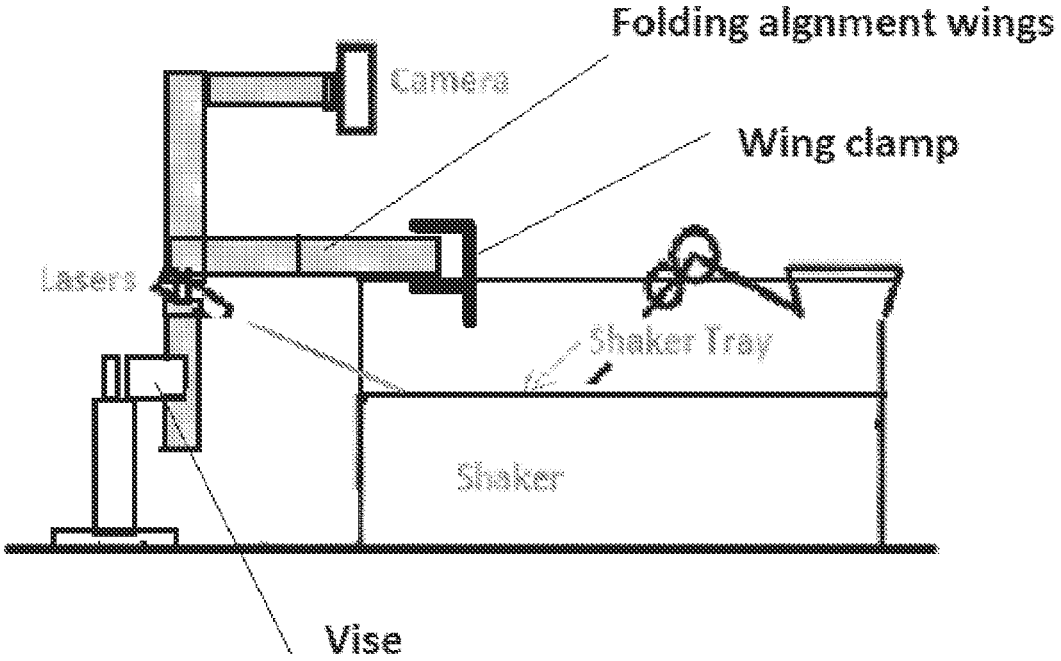
FIG. 8 illustrates a plan view of a shale shaker and camera/illumination structure according to an embodiment.
Figure 9:
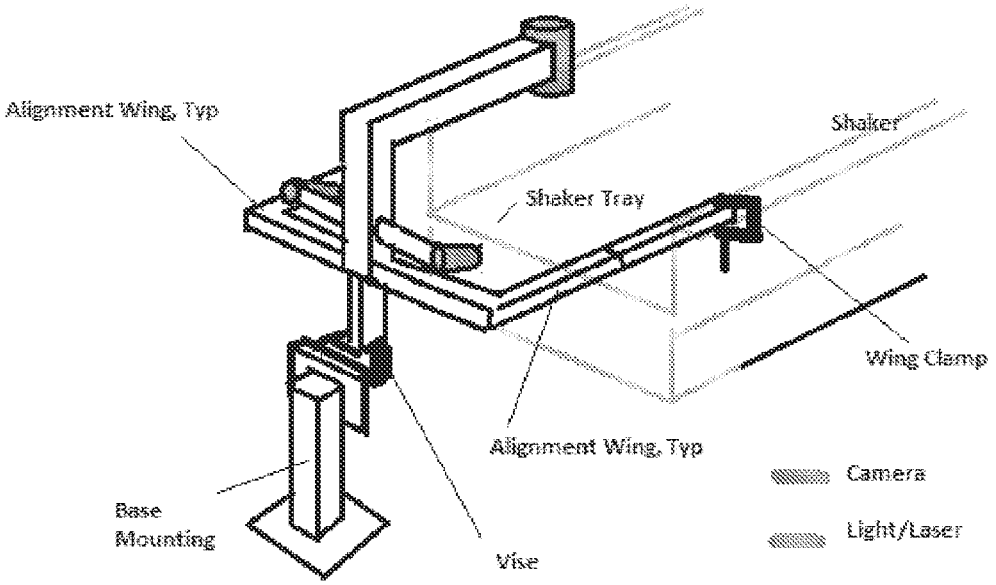
FIG. 9 illustrates an ISO view of a system according to an embodiment.

In an embodiment of the present invention, a system uses a mounting arrangement where the camera/illumination system (or structure) is outfit with folding wings, which when engaged can be clamped to the top rail of the shaker. FIG. 8 and FIG. 9 illustrate embodiments where wings are engaged.

When the wings are engaged, the camera/illumination system (or structure), which is clamped (e.g., via a vise) to a base, is loosened and the tray tilt is changed. The camera/illumination system can then move with the shaker as it tilts; thus, maintaining the same relative position and enabling the original calibration to be used regardless of tray tilt. Once the new position is assumed, the camera/illumination system is tightened to the base, and the wings are unclamped from the shaker rails and folded to their storage position.

In an embodiment, the camera or an additional camera may be used to detect if a liquid pool has crossed the light line (e.g., laser line). If using the same camera, the system detects whether the light line has become distorted (e.g., looks different) enough due to liquid pooling. The light line reflects off the pool differently than the mud. If another camera is used, it may use the light line or the addition of light to determine if liquid has pooled. If a liquid pool is forming, detection of such an event will help keep the liquid pool from overflowing and losing valuable mud constituents.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A system for measuring volume flow rate of a material, the system comprising:

an imaging receiver configured to receive images of a screen deck of a vibratory shaker from an overhead position;

at least one illumination device configured to project a line of light onto the screen deck from an angle different than a viewing angle of the imaging receiver to the screen deck; and a mounting bracket configured to hold the imaging receiver and the at least one illumination device in a substantially fixed relative position to one another and to the screen deck, wherein the system is configured to determine the volume flow rate of the material based on the images of the screen deck and of the line of light projected onto the screen deck.

2. The system according to claim 1, wherein the mounting bracket is configured to move when the screen deck is tilted upward from a horizontal position to maintain the relative position between the imaging receiver and the at least one illumination device and the screen deck.

3. The system according to claim 2, wherein the mounting bracket comprises:

a worm gear assembly; and a structure housing the worm gear assembly mounted off vertical in order to move in a direction to maintain a position of a laser projection and a camera view of the laser projection on a screen as it moves through a sweep of approximately horizontal to 7 degrees up.

4. The system according to claim 1, further comprising:

a processing system operatively coupled to the imaging receiver, the processing system comprising a processor and memory operatively coupled to the processor and storing instructions, which when executed by the processor cause the processor to perform the following functions:

receive the images, which correspond to a height of material on the screen deck; and calculate the volume flow rate of the material based on the received images and a velocity of the material.

5. The system according to claim 4, wherein the velocity of the material is calculated by the imaging receiver or provided by an independent measurement.

6. The system according to claim 4, wherein the received images include images of a position of at least a portion of the line of light, the line of light being incident on the material such that the images indicate a change in position directly proportional to the material height.

7. The system according to claim 1, the system being configured to detect a movement of the material on the screen deck as a deflection of the line of light, the deflection being horizontal from a perspective of the imaging receiver and corresponding in a linear manner to a height of the material on the screen deck.

8. The system according to claim 1, the system being configured to use at least one reference to allow for automated adjustments to a calculation of the volume flow rate based on movement of the screen deck over time.

9. The system according to claim 8, wherein the line of light crosses the at least one reference, which is mounted outside the screen deck, in order to determine a net height of the material by comparing as an offset a current position of the line of light on the at least one reference with an initial calibration position of the line of light, and adding or subtracting the offset from a material height measurement of the material.

10. The system according to claim 1, the system being configured to automatically calibrate a movement and/or misalignment of components of the system by using at least one reference to detect the movement and/or the misalignment of the components.

11. The system according to claim 1, further comprising:

a motor configured to move an assembly comprising the imaging receiver and the at least one illumination device in response to a tilt of the screen deck so that the assembly is repositioned based on reference points.

12. The system according to claim 1, wherein the at least one illumination device comprises a plurality of illumination devices.

13. The system according to claim 1, wherein the imaging receiver and the at least one illumination device are coupled to a structure having wings, which are configured to pivot into a position such that the wings are clampable to top rails of the vibratory shaker, and wherein the structure is unclampable from a base and configured such that when the structure is unclamped from the base and the wings are clamped to the top rails, the imaging receiver and the at least one illumination device move with a changing position of the screen deck as the screen deck tilts up or down.

14. The system according to claim 13, wherein the structure is configured to be clamped to the base and the wings unclamped from the top rails in order to maintain a relative position of a camera according to a corresponding tilt angle of the screen deck, and wherein the wings are configured such that when the wings are detached from the top rails the wings are foldable to a non-use position.

15. The system according to claim 13, wherein the structure is attachable to the base by a clamping device, which when loosened allows the structure to move freely up and down along a radial path as the vibratory shaker is tilted up and down, which is a pivoting move around a back end of the vibratory shaker, and when tightened clamps the structure to the base holding the structure in place and keeps the structure in a fixed relative position to the screen deck, and wherein the base is floor, wall, or ceiling mounted.

16. The system according to claim 1, wherein the system is configured to calculate a volume of the material flowing across the vibratory shaker based on a height of the material at the screen deck.

17. The system according to claim 1, wherein the imaging receiver comprises a camera and the at least one illumination device comprises a laser.

18. A method for measuring volume flow rate of a material, the method comprising:

receiving, by an imaging receiver, images of a screen deck of a vibratory shaker from an overhead position;

projecting, by at least one illumination device, a line of light onto the screen deck from an angle different than a viewing angle of the imaging receiver to the screen deck; and calculating the volume flow rate of the material based on a position of the line of light as captured by the images, wherein the imaging receiver and the at least one illumination device are in a substantially fixed relative position to one another and to the screen deck.

19. A method for measuring volume flow rate of a material, the method comprising:

receiving, by an imaging receiver, images of a screen deck of a vibratory shaker from an overhead position;

projecting, by at least one illumination device, a line of light onto the screen deck from an angle different than a viewing angle of the imaging receiver to the screen deck; and calculating the volume flow rate of the material based on a position of the line of light as captured by the images, wherein the imaging receiver and the at least one illumination device are each in a relative position to one another and to the screen deck, each relative position being at least one of dynamically measurable or adjustable.

* * * * *